US006299480B1

(12) United States Patent
Xu et al.

(10) Patent No.: US 6,299,480 B1
(45) Date of Patent: Oct. 9, 2001

(54) SHIELDED MODULAR CONNECTOR

(75) Inventors: ZhengHua Xu; DuanZheng Xu; JianQiang Zhang, all of KunShan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/568,567

(22) Filed: May 9, 2000

(30) Foreign Application Priority Data

Mar. 15, 2000 (CN) ..... 089204151

(51) Int. Cl.[7] ..... H01R 13/648

(52) U.S. Cl. ..... 439/607

(58) Field of Search ..... 439/607, 609, 439/608, 676, 541.5

(56) References Cited

U.S. PATENT DOCUMENTS 5,378,172 * 1/1995 Roberts ..... 439/607

* cited by examiner

*Primary Examiner*—Brian Sircus
*Assistant Examiner*—Javaid Nasri
(74) *Attorney, Agent, or Firm*—Wei Te Chung

(57) ABSTRACT

A modular receptacle connector of the present invention comprises a dielectric housing, a plurality of contact pin arrays assembled in the housing, a number of contact pins mounted in each contact pin array and an integral shield encasing the housing and the contact pin arrays to shield the contact pins therein. The shield comprises a bottom wall depending perpendicularly rearward from a front wall thereof, having an irregular contour at a rear edge thereof and covering a relatively large portion of the bottom surface of the dielectric housing. The irregular contour comprises a plurality of convex portions thereon engaging with corresponding cavities formed on the bottom surface of the dielectric housing. The bottom wall of the shield further comprises one row of additional grounding pins depending perpendicularly downward from the rear edge thereof.

1 Claim, 5 Drawing Sheets

SHIELDED MODULAR CONNECTOR

BACKGROUND OF THE INVENTION

1. Field of the Invention

The present invention relates to an electrical connector, and particularly to a shielded modular receptacle connector.

2. Description of the Prior Art

Modular connectors are widely used to provide electrical connections between devices, for example, connections between the telephones and the telephone switch at the central office and connections between computer equipment. Computer connections, however, are susceptible to noise due to the high frequency signal transmission involved. The susceptibility to noise (or electromagnetic interference (EMI)) is particularly severe at the connecting portion since shielding continuity for the signal path is interrupted at that site. It is for this reason that modular connectors are constructed with shields encasing the housing of the modular connector.

However, the external shield encasing the housing of the modular receptacle connector conventionally covers a very small portion at a bottom surface of the housing which abuts against the printed circuit board the modular receptacle connector is mounted to, therefore, reliable EMI shielding can not be ensured. In addition, the portion of the external shield covering the bottom surface of the housing is prone to warp and the gaps at connecting joints of the conventional external shield are too large to prevent EMI from entering the connector via these gaps, thereby further decreasing the EMI shielding effectiveness of the modular connector. On the other hand, the conventional external shield provides only a few grounding pins depending downwardly from a periphery of the bottom thereof, which do not reliably meet the demand for grounding the shielding of the modular connector to effectively dissipate the noise received by the shielding.

Therefore, an improved modular connector is desired to overcome the disadvantages of the prior art.

SUMMARY OF THE INVENTION

The major object of the present invention is to provide a modular receptacle connector which is provided with reliable EMI shielding;

Another object of the present invention is to provide a modular receptacle connector which comprises more grounding pins than the prior art.

A modular receptacle connector in accordance with the present invention comprises a dielectric housing, a plurality of contact pin arrays assembled in the dielectric housing, a plurality of contact pins mounted in each contact pin array and a shield encasing the dielectric housing and the contact pin arrays to shield the contact pins therein.

The shield of the modular connector comprises a front wall, a rear wall, a top wall, a bottom wall and a pair of side walls for covering the front surface, the rear surface, the top surface, the bottom surface and the side surfaces of the dielectric housing, respectively. The bottom wall of the shield depends rearwardly from the front wall and forms one row of additional grounding pins depending perpendicularly at the rear edge thereof. The bottom wall of the shield comprises a rear edge having an irregular contour. The irregular contour comprises a plurality of convex portions thereon to be received by corresponding cavities formed on the bottom surface of the housing, thereby preventing warping of the shield and increasing the reliability of the EMI shielding of the modular receptacle connector. Each of the side walls of the external shield comprises a front bending portion depending perpendicularly rearward from the front wall, a rear bending portion depending perpendicularly forward from the rear wall, and a main portion overlapping the rear bending portion and a part of the front bending portion.

Other objects, advantages and novel features of the invention will become more apparent from the following detailed description of the present embodiment when taken in conjunction with the accompanying drawings.

DETAILED DESCRIPTION OF THE INVENTION

Figure 1:
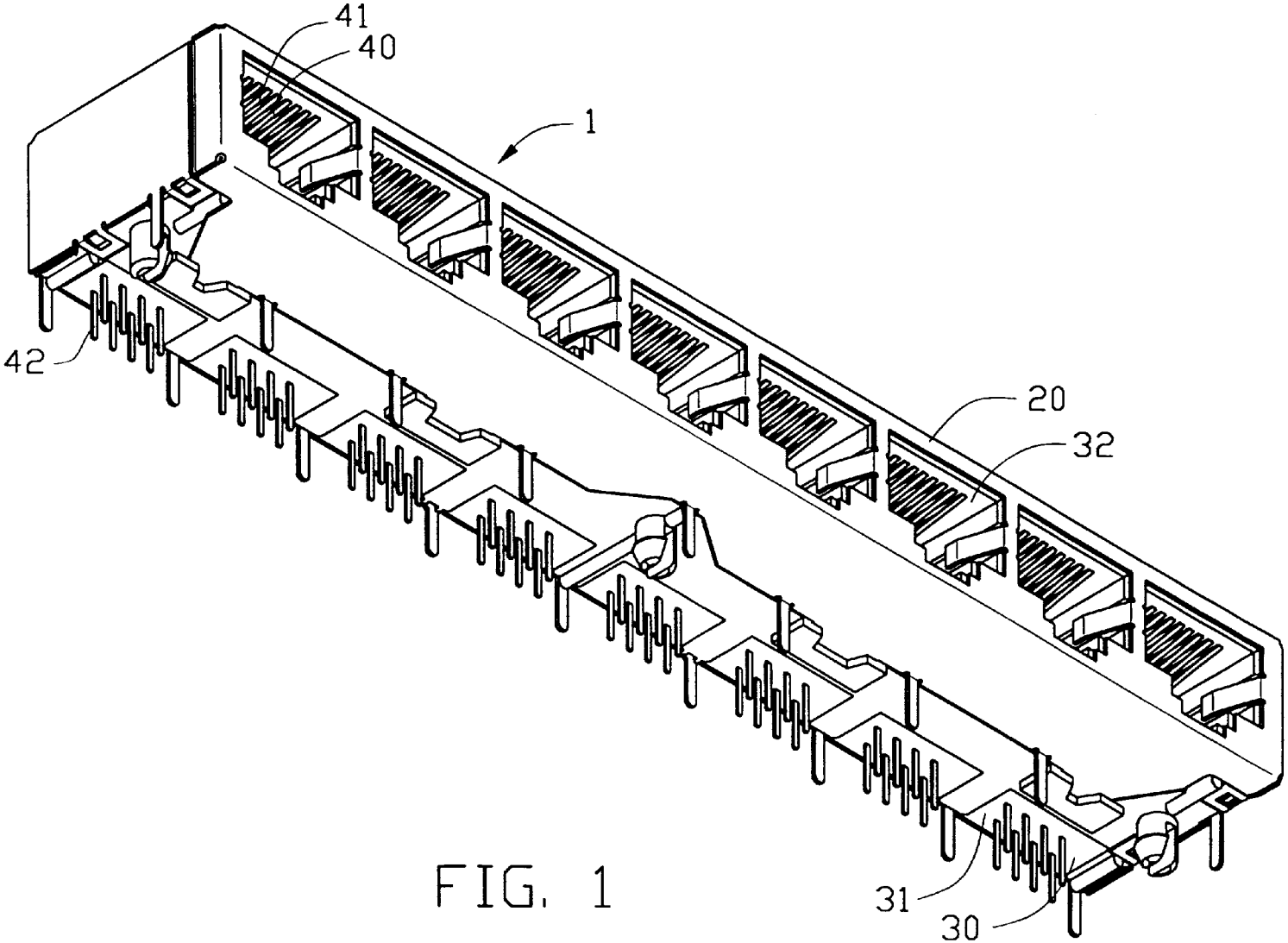
FIG. 1 is an assembled perspective view of a modular connector in accordance with the present invention.
Figure 2:
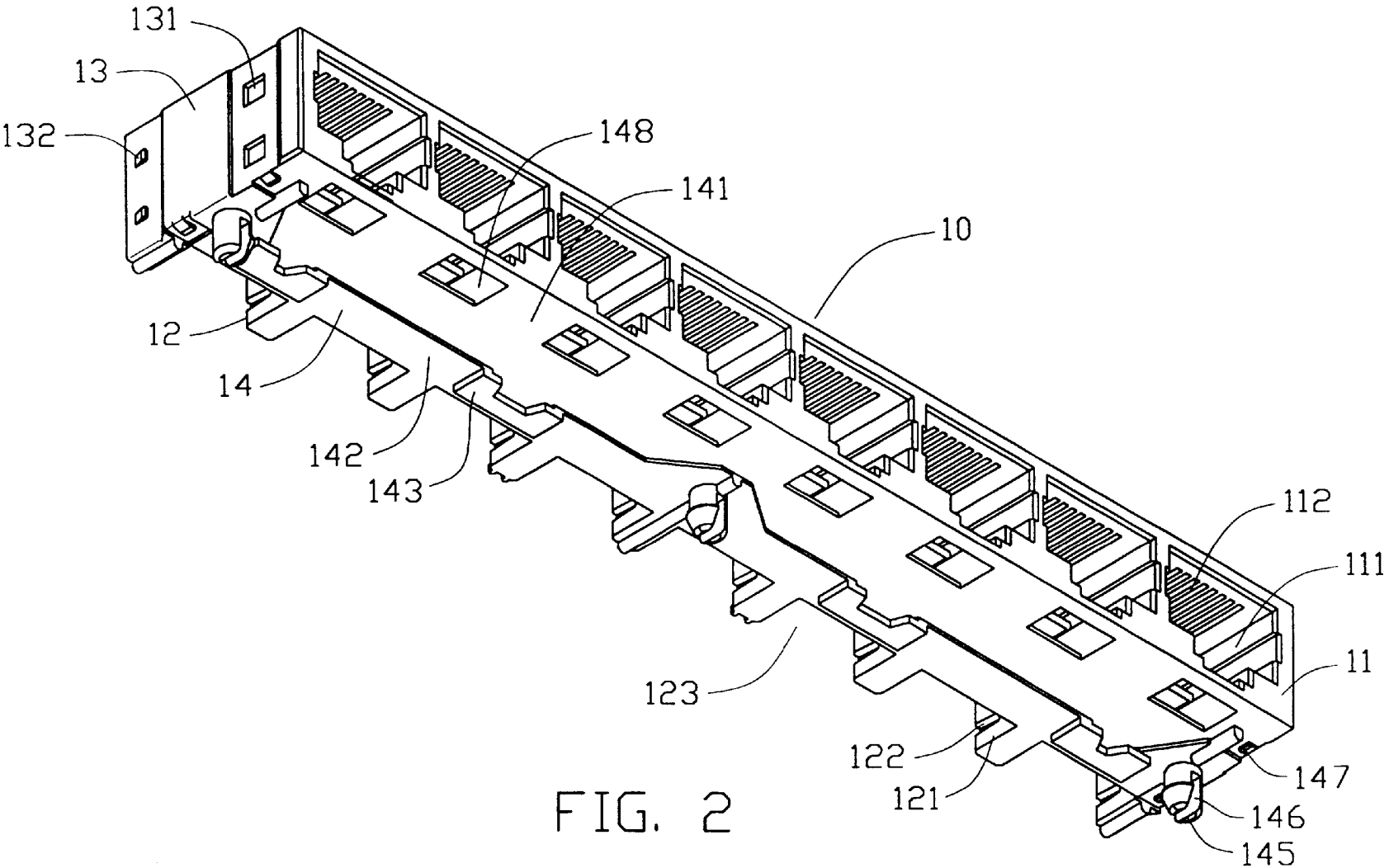
FIG. 2 is a perspective view of a dielectric housing of the modular connector of FIG. 1.
Figure 3:
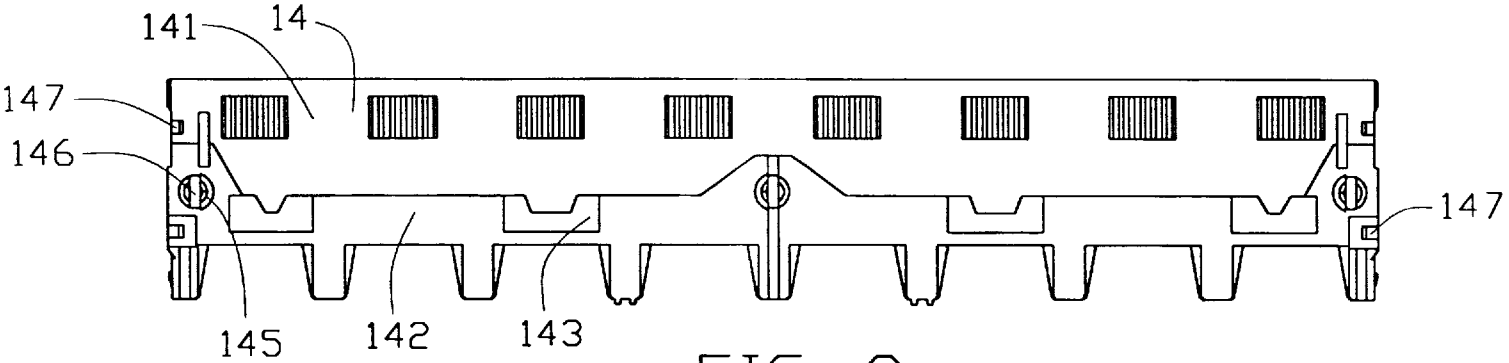
FIG. 3 is a bottom planar view of FIG.2.
Figure 4:
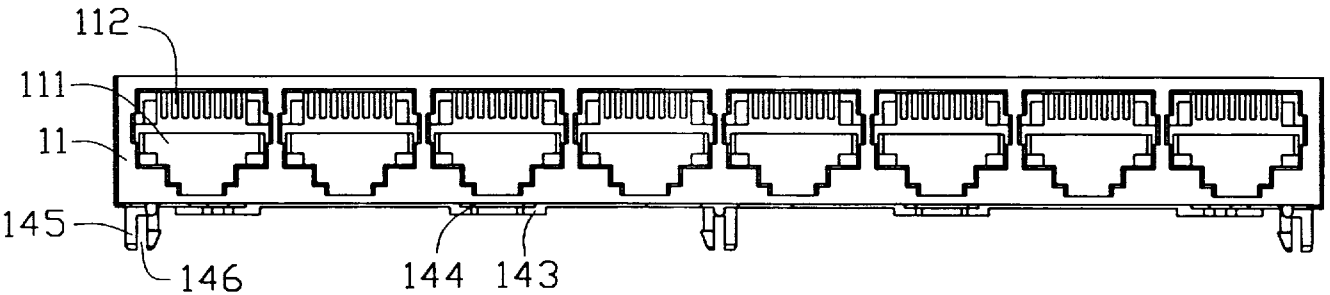
FIG. 4 is a front view of FIG. 2.
Figure 5:
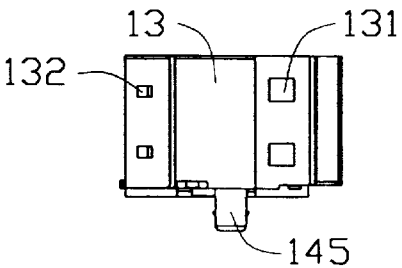
FIG. 5 is a side elevational view of FIG. 2.
Figure 6:
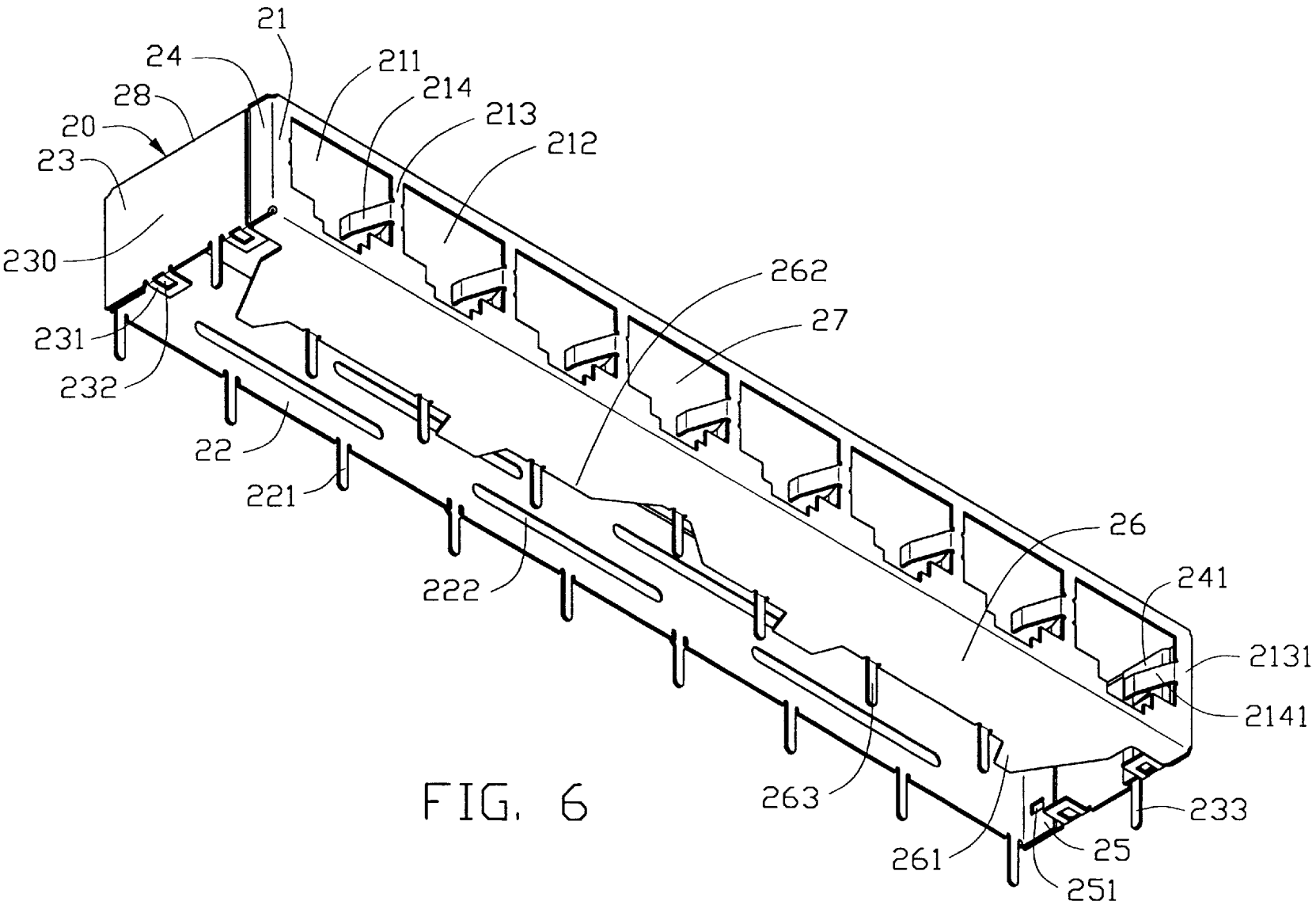
FIG. 6 is a perspective view of an external shield of the modular connector,of FIG. 1.
Figure 7:
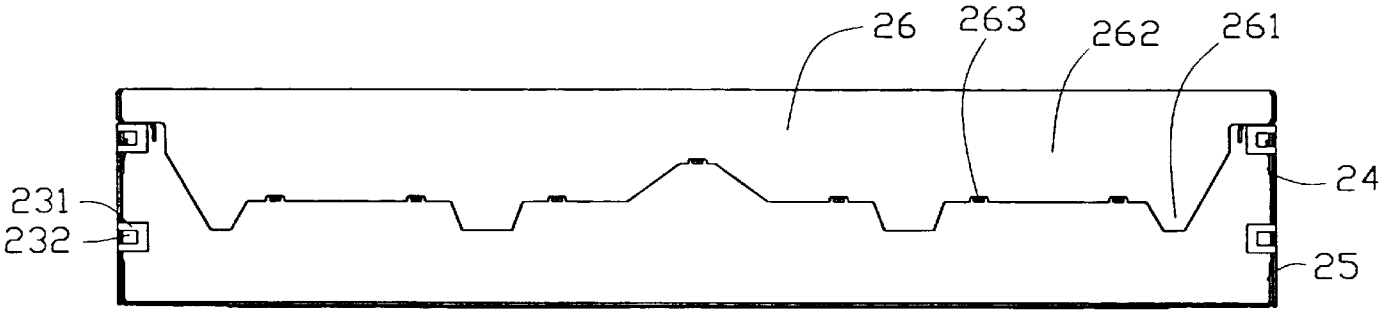
FIG. 7 is a bottom planar view of FIG. 6.
Figure 8:
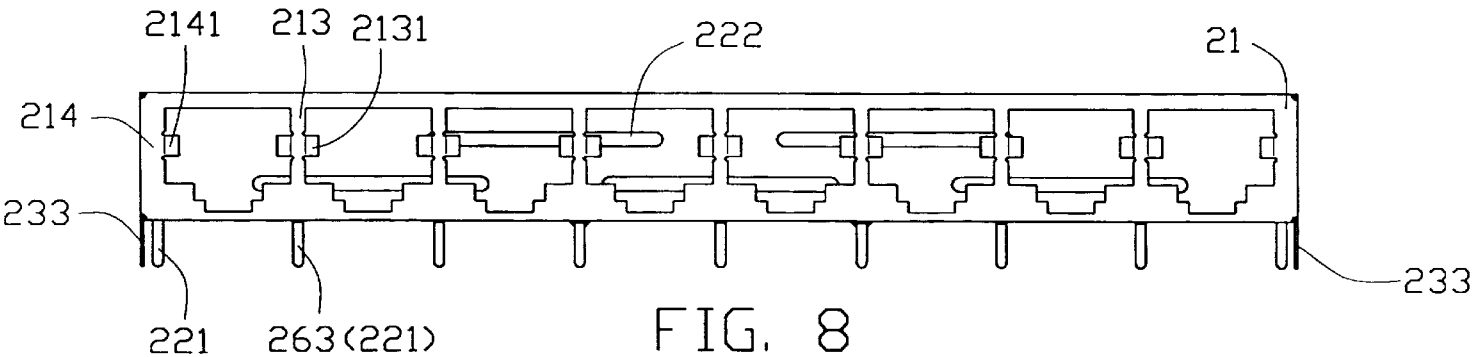
FIG. 8 is a front view of FIG. 6.
Figure 9:
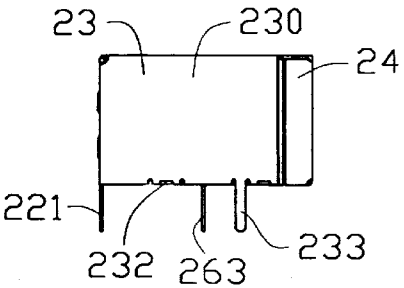
FIG. 9 is a side elevational view of FIG. 6.

Referring to FIG. 1, a modular receptacle connector 1 in accordance with the present invention comprises a dielectric housing 10, an integral external shield 20, a plurality of contact pin arrays 30 and a plurality of contact pins 40 mounted in each contact pin array 30.

Each contact pin array 30 is L-shaped and comprises a vertical portion 31 and a horizontal portion 32. Each contact pin 40 comprises a contact portion 41 and a mounting portion 42.

Referring now to FIGS. 2–5, the dielectric housing 10 comprises a front surface 11, a rear surface 12 opposite to the front surface 11, a pair of side surfaces 13, a top surface (not labeled) and a bottom surface 14 for mounting to a printed circuit board (not shown). The front surface 11 defines eight side by side ports 111 recessed thereinto for receiving corresponding mating plugs of complementary modular connectors (not shown). A plurality of passageways 112 are defined at the front portion of an inner top surface (not labeled) of each port 111 which open rearwardly therefrom. The passageways 112 in each port 111 correspond in quantity to passages (not labeled) formed on the horizontal portion 32 of one contact pin array 30. The rear surface 12 forms nine ribs 121 extending vertically between the bottom surface 14 and the top surface (not labeled) of the housing 10. The ribs 121 bound eight corresponding slots 123 therebetween. Each slot 123 is in communication with one port 111. A pair of recesses 122 is formed at a lower portion of each rib 121, except that only one recess 122 is defined in each inner surface of the two ribs 121 at opposite lateral ends of the housing 10. Each of the side surfaces 13 comprises a pair of front latch holes 131 at the front portion thereof and a pair of rear latch tabs 132 at the rear portion thereof. The bottom surface 14 comprises a front portion 141 having eight rectangular apertures 148 in communication with the ports 111, respectively, and a rear portion 142. The rear portion 142 of the bottom surface 14 is a little thicker than the front portion 141 and takes on an irregular contour at the front edge thereof. Four latch blocks 143 are disposed at the front edge of the rear portion 142. One cavity 144 is defined in each latch block 143. The bottom surface 14 further comprises three mounting posts 145 at two longitudinal ends and at a center portion of the rear portion 142. Each of the mounting posts 145 is longitudinally split into two parts by a slit 146 defined in substantially a center thereof for providing resilience during mounting. A pair of tabs 147 are formed on each of the lateral edges of the bottom surface 14.

Referring now to FIGS. 6–9, the external shield 20 is integrally formed and comprises a front wall 21, a rear wall 22 opposite to the front wall 21, a pair of opposite side walls 23, a bottom wall 26 and a top wall 27 opposite to the bottom wall 26. The front wall 21 defines eight openings 211. The openings 211 correspond in shape to the ports 111 of the housing 10. Each of the openings 211 is bound in a horizontal direction by a pair of strips 213 or a strip 213 and a side strip 2131. The strips 213 each form a pair of tips 214, one each extending rearward into adjacent openings 212. The side strips 2131 each form one tip 2141 extending reward into its adjacent opening 211. The rear wall 22 forms one row of grounding pins 221 extending straight downward from the lowest edge thereof and two rows of elongated embossments 222 extending in a longitudinal direction thereof. Each of the side walls 23 comprises a main portion 230, a front bending portion 24 and a rear bending portion 25. The front bending portions 24 perpendicularly depend rearward from lateral ends of the front wall 21 and the rear bending portions 25 perpendicularly depend forward from lateral ends of the rear wall 22. The main portion 230 overlaps the rear bending portion 25 and nearly half of the front bending portion 24. Each of the front bending portions 24 forms a pair of protrusions 241 protruding inwardly from an inner face thereof. Each of the rear bending portions 25 defines a pair of latch apertures 251. The main portions 230 each comprise a pair of tongues 231 depending perpendicularly inward from a bottom end thereof adjacent to the front and the rear bending portions 24, 25, respectively, and a side grounding pin 233 adjacent to the tongue 231 near the front bending portion 24. Each tongue 231 defines a tongue aperture 232 in the center thereof. The bottom wall 26 extends perpendicularly rearward from the bottom end of the front wall 21 and has an irregular contour at the rear edge thereof corresponding in shape to the front edge of the rear portion 142 of the bottom surface 14 of the housing 10. There are convex portions 261 and concave portions 262 on the rear edge of the bottom wall 26. One row of additional grounding pins 263 depend perpendicularly downward from the concave portions 262 of the bottom wall 26.

In assembly, the contact pins 40 are inserted into the contact pin arrays 30 and are bent according to the shape of the contact pin arrays 30. The contact portions 41 are curvedly received in the horizontal portions 32 and the mounting portions 42 extend straight downward beyond the bottom of the vertical portions 31. The subassemblies of the contact pin arrays 30 and the contact pins 40 are mounted in the dielectric housing 10. The vertical portion 31 of each contact pin array 30 is accommodated by one slot 123 of the housing 10 and is secured in position by the recesses 122 of adjacent ribs 121 interferentially engaging with corresponding structures (not shown) on the side walls of the contact pin arrays 30. The horizontal portions 32 extend from the rear surface 12 of the housing 10 into corresponding ports 111 thereby mounting contact portions 41 of the contact pins 40 in the top of the ports 111. The shield 20 is then assembled to the housing 10. The latch apertures 251 receive the rear latch tabs 132, the protrusions 241 engage with the front latch holes 131, the tabs 147 mate with the tongue apertures 232 and the convex portions 261 extend into the cavities 144.

The bottom wall 26 covers a relatively large portion of the bottom surface 14 of the dielectric housing 10, generally occupying almost the front half of the area of the bottom surface 14 under the mating portions of the receptacle and plug connectors thereby providing efficient shielding, and the engagement of the convex portions 261 with the cavities 144 enhances the restraint connection between the shield 20 and the housing 10 especially in the vertical direction, so the EMI shielding is reliable. The additional grounding pins 263 increase the total number of the grounding pins on the modular connector 1, thereby improving grounding effectiveness of the modular connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular receptacle connector comprising:

a dielectric housing comprising a pair of side surfaces, a front surface, a rear surface, a top surface and a bottom surface, the front surface defining at least a port therein for receiving a mating plug connector;

a contact pin array assembled in the dielectric housing, the contact pin array being partially received by the port and comprising a horizontal portion and a vertical portion;

a plurality of contact pins mounted in the contact pin array, each contact pin comprising a contact portion received by the horizontal portion of the contact pin array and a mounting portion extending beyond the vertical portion of the contact pin array; and a shield encasing the dielectric housing and the contact pin array, the shield comprising a front wall, a rear wall, a pair of side walls, a top wall for covering the front surface, the rear surface, the side surfaces, the top surface of the dielectric housing, respectively, and a bottom wall, the front wall defining an opening corresponding to the port of the dielectric housing, the bottom wall extending rearward from a bottom edge of the front wall along the bottom surface of the dielectric housing and having latching structures engaging with the bottom surface of the dielectric housing at a position near the rear surface of the dielectric housing; wherein the bottom wall of the external shield has an irregular contour at a rear edge thereof and the bottom surface of the dielectric housing comprises a rear portion and a front portion, the front portion being a little thinner than the rear portion and having a configuration corresponding to the bottom wall to be covered by the bottom wall; wherein the irregular contour of the bottom wall of the external shield comprises concave portions and convex portions, and the rear portion of the bottom surface of the dielectric housing comprises a plurality of latch blocks thereon defining cavities therein for receiving the convex portions of the bottom wall; wherein the rear wall of the external shield comprises one row of grounding pins extending straight downward from a bottom edge thereof, and the rear edge of the bottom wall of the eternal shield has another row of additional grounding pins extending perpendicularly downward therefrom; wherein each of the side walls of the external shield comprises a front bending portion depending perpendicularly rearward from the front wall, a rear bending portion depending perpendicularly forward from the rear wall, and a main portion depending perpendicularly downward from a lateral edge of the top wall and overlapping the rear bending portion and a rear part of the front bending portion; wherein each of the side surfaces of the dielectric housing comprises a pair of front latch holes and a pair of rear latch tabs thereon, and the front bending portion of each side wall comprises a pair of protrusions for engaging with the front latch holes, respectively, and the rear bending portion of each side wall comprises a pair of latch apertures for mating with the rear latch tabs, respectively; wherein the bottom surface of the dielectric housing forms a pair of tabs at each of the lateral edges thereof and the main portion of each side wall of the external shield defines a pair of tongues depending perpendicularly inward and each defining a tongue aperture in a center thereof corresponding to the tabs of the bottom surface; wherein the shield is made from one piece.

* * * * *